United States Patent [19]

Gruber et al.

[11] Patent Number: 4,737,434

[45] Date of Patent: Apr. 12, 1988

[54] PROCESS FOR COLORED TONERS WITH SELECTED TRIBOELECTRIC CHARACTERISTICS

[75] Inventors: Robert J. Gruber, Pittsford; John F. Knapp, Fairport, both of N.Y.

[73] Assignee: Xerox Corporation, Stamford, Conn.

[21] Appl. No.: 846,668

[22] Filed: Mar. 31, 1986

[51] Int. Cl.[4] ..... G03G 13/08; G03G 13/16

[52] U.S. Cl. ..... 430/120; 430/109; 430/110; 430/126

[58] Field of Search ..... 430/109, 110, 120, 126

[56] References Cited

U.S. PATENT DOCUMENTS

| | | | |
|---|---|---|---|
| 3,669,922 | 6/1972 | Bartsch et al. | 260/41 R |
| 3,720,617 | 3/1973 | Chatterji et al. | 430/110 |
| 4,397,934 | 8/1983 | Lu | 430/110 |
| 4,430,409 | 2/1984 | Matsumoto et al. | 430/110 X |
| 4,457,998 | 7/1984 | Gruber et al. | 430/98 |
| 4,473,628 | 9/1984 | Kasuya et al. | 430/109 |
| 4,513,074 | 4/1985 | Nash et al. | 430/109 X |

FOREIGN PATENT DOCUMENTS

| | | | |
|---|---|---|---|
| 57-130047 | 8/1982 | Japan | 430/109 |
| 58-33263 | 2/1983 | Japan | 430/109 |
| 58-125045 | 7/1983 | Japan | 430/109 |

*Primary Examiner*—Roland E. Martin

*Attorney, Agent, or Firm*—E. O. Palazzo

[57] ABSTRACT

A process for generating consistent high quality colored images for extended periods consisting essentially of (1) providing a xerographic imaging or printing apparatus; (2) adding thereto a stable two-component developer composition comprised of first polymer particles, second polymer particles, and blended flow additive particles and carrier particles; (3) forming electrostatic latent images in the apparatus; and (4) developing the images formed wherein the developer composition retains its triboelectric properties of from about 20 to about 40 microcoulombs per gram for over 500,000 imaging cycles, subject to the provision that the second polymer particles are of a different composition than the first polymer particles.

20 Claims, 1 Drawing Sheet

PROCESS FOR COLORED TONERS WITH SELECTED TRIBOELECTRIC CHARACTERISTICS

BACKGROUND OF THE INVENTION

Figure 1:
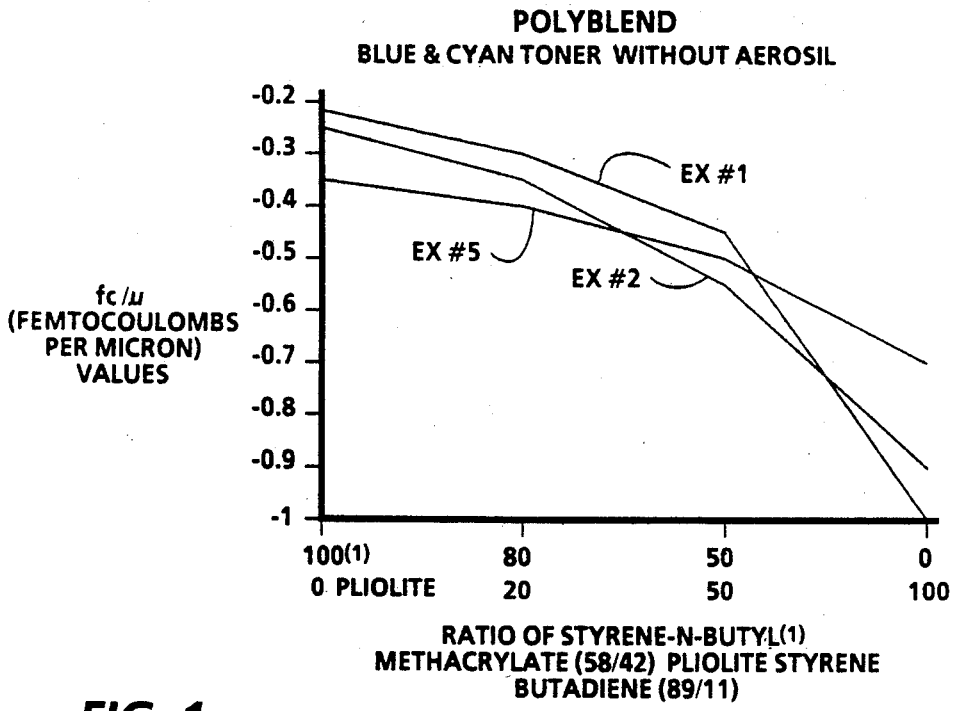

This invention is generally directed to processes for generating colored images of consistent quality for a substantial number of imaging cycles, and wherein the toners selected retain their triboelectric characteristics, and possess excellent admix characteristics. More specifically, there are provided in accordance with the present invention processes for generating images and prints of high quality with a color developer composition that retains its triboelectric charging properties for in excess of 500,000 imaging cycles. Further, in accordance with the present invention, the triboelectric charging values desired for the color toners can be preselected, that is the level of charge and the direction of this charge can be predetermined. The aforementioned toner and developer compositions also possess excellent fusing characteristics. Specifically, thus the toner compositions of the present invention comprised of specific mixture of polymers are useful in xerographic imaging and printing processes, inclusive of those embodied by the commercially available Xerox Corporation 9700® and 5600® apparatuses. In these apparatuses, the developer compositions of the present invention possess stable triboelectric charging characteristics for the entire imaging sequence; and further, these triboelectric charges can be preselected, properties not readily achievable with many prior art processes and compositions. Moreover, with the process and developer compositions of the present invention, there are permitted other outstanding characteristics as disclosed hereinafter inclusive of rapid admix properties.

Toner compositions, inclusive of colored toner compositions, are known. These compositions are generally comprised of resin particles, pigment particles selected from cyan, magenta, yellow, red, green, blue, or mixtures thereof; and optional additive particles including, for example, metal salts of fatty acids, and colloidal silicas. The triboelectric characteristics of the aforementioned colored toners are generally determined by the particular pigments selected. Additionally, the level and direction of charge can be significantly altered depending on the selection of the polymer component within which the pigment is dispersed. Accordingly, with only a limited number of acceptable toner resins, and the scarcity of desirable charge enhancing additives, the ability to modify the triboelectric properties of colored toners is rather limited. One problem solved with the process of the present invention enables the selection of a wide variety of polymers while simultaneously enabling colored toner particles with preselected stable triboelectric charging characteristics; and wherein the aforementioned toner compositions possess good admix characteristics, that is new uncharged toner particles added to the imaging apparatus, acquire the appropriate polarity and triboelectric charging value in a rapid time period less than, for example, 5 minutes. This is accomplished primarily by the mixing of polymers as illustrated hereinafter.

There is disclosed in U.S. Pat. No. 3,669,922 colored thermoplastic powders which can be prepared by grinding coarse colored film of plastic cubes or pellets to the desired sizes. These powders can be obtained by incorporating pigments or dyes in a mixture or blends of resins which are subsequently passed through a high shear pulverizing device, reference column 1, beginning at line 57, and continuing on to line 67. This patent, however, is silent with respect to, for example, achieving rapid admix with constant triboelectric charging characteristics for toner compositions. Further, it is known, for example, that additives such as Aerosil will have a tendency to increase the negative triboelectric charging values on the toner compositions while simultaneously adversely affecting the admix charging time periods. The aforementioned problem is substantially eliminated with the process of the present invention.

Further, there is disclosed in U.S. Pat. No. 4,457,998 improved developer compositions comprised of toner particles containing an uncrosslinked polymer incorporated into a polymer network which has been highly crosslinked in the presence of the uncrosslinked polymer, and uncrosslinked polymer being of a different composition than the crosslinked polymer. As examples of uncrosslinked polymers, there is illustrated in this patent styrene/alkyl acrylate polymers, and styrene butadiene polymers; and a crosslinked polystyrene/n-butylmethacrylatemaleic anhydride terpolymer.

In U.S. Pat. No. 4,473,628 there is illustrated a toner with emulsions of two polymers having different characteristics. More specifically, in accordance with the teachings of this patent, there is described a toner for developing electrostatic latent images with a binder resin prepared by mixing two emulsions, coagulating the emulsion mixture, separating the solid from the latent, and dehydrating into a solid product. One preferred example of the mixed resin that can be selected is a mixture of styrene butadiene copolymers, reference column 2, beginning at line 15. In accordance with the teachings of this patent, the toner was designed in a manner so as to possess acceptable rheology with no teaching therein as to obtaining simultaneously stable triboelectric charging values and rapid admix charging characteristics.

Additionally, there is disclosed in copending application U.S. Ser. No. 655,381, entitled Toner Compositions With Crosslinked Resins and Low Molecular Weight Waxes, an improved positively charged toner composition comprised of a polyblend mixture of a crosslinked copolymer composition and a second polymer, pigment particles, a wax component of molecular weight of from about 500 to about 20,000, and a charge enhancing additive. The disclosure of the aforementioned copending application is totally incorporated herein by reference.

Moreover, disclosed in copending application Ser. No. 681,177, entitled Process for Achieving Consistent High Quality Images With Magnetic Developers, is a process for generating consistent high quality images for extended periods, and wherein the developer retains its electrical properties for over 2.5 million imaging cycles. There is selected for the aforementioned process a stable two-component developer comprised of resin particles, first pigment particles, second magnetic pigment particles, and blended flow additive particles. The disclosure of the aforementioned copending application is totally incorporated herein by reference.

Therefore, there is a need for colored toner compositions wherein the triboelectric charging characteristics thereof can be preselected. Also, there is a need for stable colored developer compositions that will enable the generation of developed images with exceptional quality, and further, wherein these compositions will maintain their triboelectric charging properties for substantially unlimited imaging cycles. Additionally, there is a need for imaging processes with colored developer compositions that possess reduced aging characteristics in xerographic imaging and printing systems. Aging, a prevalent problem in many xerographic imaging processes, involves for example continuous reduction in toner charging capability, which eventually causes copy quality degradation as is evidenced, for example, by excessive background printout. Accordingly, the present invention enables xerographic imaging and printing processes with colored developer compositions that retain their triboelectric properties, and in particular their triboelectric charging values for an extended number of imaging cycles, exceeding 500,000 for example. In contrast, with similar prior art imaging processes using colored developer compositions, a triboelectric charge typically, undesirably decays continuously beginning with about 100 imaging cycles. Furthermore, there remains a need for colored toner compositions with selected triboelectric characteristics which simultaneously possess acceptable fusing properties. Also, there is an important need for toner compositions which simultaneously possess excellent admix characteristics thereby enabling uncharged toner particles added to the imaging apparatus to achieve the appropriate constant triboelectric charging value within a short time period, for example prior to 5 minutes.

SUMMARY OF THE INVENTION

It is an object of the present invention to provide processes for obtaining color images of excellent resolution.

In another object of the present invention there are provided processes for formulating colored toners useful in permitting the development of electrostatic latent images.

Also, in another object of the present invention there are provided processed for formulating colored toners with preselected stable triboelectric charging values.

Furthermore, in yet still another object of the present invention there are provided processes for obtaining images of consistent high quality for extensive time periods with a colored developer composition that retains its triboelectric charging values.

A further object of the present invention resides in the provision of imaging processes with colored toner compositions formulated by the blending or mixing of polymers.

In still a further object of the present invention there are provided printing processes with colored toner compositions formulated by the mixing of polymers.

Also, in yet another object of the present invention there are provided toner compositions with excellent admix characteristics.

These and other objects of the present invention are accomplished by providing a process for affecting the development of images with a stable, two-component developer composition with preselected stable triboelectric charging characteristics, rapid admix charging characteristics, and other desirable development properties for substantially unlimited imaging cycles. More specifically, thus the two-component developer compositions selected for the present invention are comprised of a mixture of polymers; colored pigments selected from the group consisting of cyan, magenta, yellow, red, green, blue and brown; additives particles; and carrier particles. More specifically, there are provided in accordance with the present invention printing and imaging processes with two-component color developer compositions formulated by the mixing of different polymers, colored pigment particles selected from the group consisting of cyan, magenta, and yellow; flow aid additives, such as colloidal silicas; and carrier particles consisting essentially of a core with an optical coating thereover. With the aforementioned developer compositions the triboelectric charging value on the toner particles can be preselected, and rapid admixing is achieved. Further, the triboelectric charge is stable for a substantially unlimited number of copying cycles. Additionally, there can be achieved with these developer compositions excellent fusing characteristics; negatively charged toner resins; and other similar properties as illustrated hereinafter.

In one specific embodiment of the present invention, there are provided improved imaging or printing processes with a two-component colored developer composition wherein the toner is comprised of a mixture of (1) a first polymer; (2) a second polymer; (3) colored pigment particles selected from the group consisting of cyan, magenta, yellow, red, blue, and green; and (4) colloidal silica flow aid additives, subject to the provision that the first and second polymers constituting the mixture are incompatible or of a different composition.

In one embodiment of the present invention, there are provided imaging the printing processes with a toner composition comprised of a polyblend mixture of (1) a first polymer selected from the group consisting of styrene methacrylates, styrene acrylates, polyesters, polyamides, polyvinylchlorides, and styrene butadienes; (2) a second different polymer selected from the group consisting of styrene acrylates, styrene methacrylates, polyesters, and styrene butadienes; (3) colored pigment particles selected from the group consisting of cyan, magenta, red, green, blue, and yellow; and (4) colloidal silica flow aid additives.

Of importance with respect to the present invention is the selection and blending of the first and second polymer compositions. The specific polymer selected as well as the mixing ratios thereof enable the preselection of the toner triboelectric charging properties and rapid admix charging properties. Accordingly, there is generally mixed from about 1 to about 99 percent by weight of the first polymer, and from about 99 percent by weight to about 1 percent by weight of the second polymer enabling a stable triboelectric charge on the toner of from about (a negative) −8 microcoulombs per gram to about −30 microcoulombs per gram. The first and second polymers in the perferred embodiment of the present invention are blended in an amount of from about 60 to about 40 percent by weight of the first polymer to about 40 to about 60 percent by weight of the second polymer enabling a negative triboelectric charging value on the toner particles of from about −15 microcoulombs per gram to about −25 microcoulombs per gram.

Illustrative examples of polymers selected for the toner compositions illustrated herein include polyesters, styrene/butadiene resins, styrene/methacrylate resins, epoxies, vinyl resins, polyamides, polyvinyl chloride, and polymeric esterification products of a dicarboxylic acid and a diol comprising a diphenol. Suitable vinyl resins include homopolymers or copolymers of two or more vinyl monomers, such as vinyl esters such as vinyl acetate, vinyl butyrate and the like; esters of alphamethylene aliphatic monocarboxylic acids inclusive of methyl acrylate, ethyl acrylate, n-butylacrylate, isobutyl acrylate, methyl methacrylate, ethyl methacrylate, butyl methacrylate and the like; diolefins including styrene butadiene copolymers, and the like.

The preferred polymers are selected from polystyrene metharcylates; polyesters such as those described in U.S. Pat. No. 3,655,374, the disclosure of which is totally incorporated herein by reference; polyester resins resulting from the condensation of dimethylterephthalate, 1,3 butanediol, and pentaethylthriol; and Pliolite resins. The Pliolite resins are believed to be copolymer resins of styrene and butadiene, wherein the styrene is present in an amount of from about 80 weight percent to about 95 weight percent, and the butadiene is present in an amount of from about 20 weight percent to about 5 weight percent. A specific styrene butadiene resin found highly useful in the present invention is comprised of about 89 percent of styrene, and 11 percent of butadiene.

There is incorporated into the polymer mixture in an amount of from about 2 percent by weight to about 20 percent by weight the colored pigment particles illustrated hereinbefore, inclusive of red, green and blue. Examples of magenta, cyan and yellow pigments, or colorants selected for the toner compositions of the present invention are well known including, for example, the magenta compounds 2,9-dimethyl-substituted quinacridone and anthraquinone dye identified in the color index as Cl 60710; Cl Dispersed Red 15, a diazo dye identified in the color index as Cl 16050; Cl Solvent Red 19; and the like. Examples of cyan materials that may be used as pigments include copper tetra-4(octadecyl sulfonamido) phthalocyanine; X-copper phthalocyanine pigment listed in the color index as Cl 74160; Cl Pigment Blue; and Anthrathrene Blue, identified in the color index as Cl 69810; Special Blue X-2137; and the like; while illustrative examples of yellow pigments that may be selected include diarylide yellow 3,3-dichlorobenzidene acetoacetanilides; a monazo pigment identified in the color index as Cl 12700; Cl Solvent Yellow 16; a nitrophenyl amine sulfonamide identified in the color index as Foron Yellow Se/GLN; Cl Dispersed Yellow 33, 2,5-dimethoxy-4-sulfonanilide phenylazo-4'-chloro-2,5-dimethoxy aceto-acetanilide; and Permanent Yellow FGL.

Additive particles incorporated into the toner compositions illustrated herein include, for example, colloidal silicas, reference U.S. Pat. Nos. 3,900,588 and 3,720,617, the disclosures of which are totally incorporated herein by reference. Other additives that may be selected include metal salts, or metal salts of a fatty acid, reference for example U.S. Pat. No. 3,983,045, the disclosure of which is totally incorporated herein by reference. These additives are generally present in an amount of from about 0.1 percent by weight to about 1 percent by weight. Preferred additives include zinc stearate and Aerosil R972.

Carrier particles that can be selected for mixing with the toner compositions of the present invention inclued specific substances, that is those that will enable the process of the present invention. Accordingly, the carrier particles are selected from those consisting of cores of iron, ferrits, inclusive of the ferrites described in U.S. Pat. No. 3,914,181, the disclosure of which is totally incorporated herein by reference; and reclaimed ferrites, with coatings thereover of terpolymers of styrene, methacrylate and vinyltriethoxysilane; and polymethacrylate. Other carrier particles not specifically disclosed herein can be selected providing the objectives of the present invention are achieved. Moreover, it is important with respect to the imaging and printing processes of the present invention that the carrier coatings have incorporated therein as an optional component carbon black, or other similar conductive pigments.

The diameter of the carrier particles can vary, generally however, this diameter is from about 50 microns to about 250 microns allowing these substances to possess sufficient density and inertia to avoid adherence to the electrostatic images during the development process. The carrier particles can be mixed with the toner composition in various suitable effective combinations including, for example, about 1 part per toner to about 10 parts to about 200 parts by weight of carrier, and preferably from about 1 to about 5 parts by weight of toner to about 100 parts by weight of carrier particles.

Additionally, there can be selected nickel berry carriers as described in U.S. Pat. Nos. 3,847,604 and 3,767,598, the disclosures of which are totally incorporated herein by reference. Also, the aforementioned terpolymer coatings are illustrated in U.S. Pat. Nos. 3,467,634 and 3,526,533, the disclosures of which are totally incorporated herein by reference.

With further reference to the toner compositions, they can be prepared by a number of known methods including the melt blending of the first and second polymer compositions, the colored pigment particles, followed by mechanical attrition. The additive colloidal silica particles can then be blended onto the toner composition surface. Other known methods can be selected provided the objectives of the present invention are achieved. These processes result in negatively charged color toner compositions in relation to the carrier materials selected; and further, these compositions exhibit the improved properties as mentioned hereinbefore. The toner and developer compositions of the present invention are very useful for affecting the development of colored electrostatic latent images, particularly those present on an imaging member charged positively. Examples of photoconductive imaging members that may be selected include selenium; selenium alloys, inclusive of selenium tellurium, selenium arsenic, selenium tellurium arsenic; halogen doped selenium substances; and halogen doped selenium alloys. The halogens selected, preferably chlorine, are present in an amount of from about 50 to about 200 parts per million. Accordingly, the imaging method of the present invention comprises the formation of a positively charged electrostatic image on a photoconductor, contacting the image with the color developer compositions of the present invention comprised of toner particles and carrier particles, subsequently transferring the developed colored image to a suitable substrate, inclusive of paper; and permanently affixing the image thereto by various suitable means such as heat. Also, the developer compositions of the present invention may be useful in electrostatographic imaging apparatuses having incorporated therein layered photoresponsive members comprised of aryl amine hole transport layers and photogenerating layers containing therein X metal free phthalocyanines, metal phthalocyanines, or vanadyl phthalocyanines. The aforementioned layered photoresponsive members are disclosed in many U.S. patents inclusive of U.S. Pat. No. 4,265,990, the disclosure of which is totally incorporated herein by reference.

One preferred colored toner composition of the present invention enabling a stable triboelectric charge of from about −25 to about −30 microcoulombs per gram is comprised of about 50 percent by weight of styrene methacrylate polymer particles; about 45 percent by weight of styrene butadiene polymer particles; about 5 percent by weight of cyan, magenta, or yellow pigment particles; about 0.35 percent by weight of colloidal silica; and carrier particles consisting of a core of ferrite or steel, with a coating thereover of a methyl terpolymer or polymethylmethacrylate. Other triboelectric charging characteristics can be achieved depending on the polymer selected, and the ratios thereof blended together. For example, the following table provides data as to the triboelectric charging range with the polymers indicated.

The following examples are being supplied to further define various species of the present invention, it being noted that these examples are intended to illustrate and not limit the scope of the present invention. Parts and percentages are by weight unless otherwise indicated.

EXAMPLE I

There was prepared a toner composition by melt blending 10 percent by weight of Sudan OS, 45 percent by weight of styrene-n-butylmethacrylate (45/52), and 45 percent by weight of a styrene butadiene resin, available as Pliolit from Goodyear, followed by micronization and classifying the resulting toner particles resulting in an average diameter for these particles of about 8.5 microns. There was subsequently added to this composition 0.3 percent by weight of Aerosil R972.

EXAMPLE II

A blue toner composition was prepared by repeating the procedure of Example I with the exception that there was selected Sudan Blue OS, 9 percent, and 1 percent of Hostaperm Pink.

EXAMPLE III

A blue toner composition was prepared by repeating the procedure of Example II with the exception that there was selected 62 percent by weight of the Pliolite resin, and 28 percent by weight of the styrene-n-butylmethacrylate resin.

EXAMPLE IV

A blue toner composition was prepared by repeating the procedure of Example II with the exception that there was selected 75 percent by weight of Pliolite resin, and additionally there was included in the toner composition 15 percent by weight of a polyamide resin available as Emerez 1540 from Emery Industries, Inc..

EXAMPLE V

A blue toner composition was prepared by repeating the procedure of Example II with the exception that there was selected in place of the Sudan and Hostaperm 10 percent by weight of Neozapan Blue 807.

EXAMPLE VI

A magenta toner composition was prepared by repeating the procedure of Example I with the exception that there was selected 10 percent by weight of Hostaperm Pink, 68 percent by weight of the styrene-n-butylmethacrylate, and 22 percent by weight of the Pliolite. To this toner composition there was added 0.6 percent by weight of the Aerosil R972 rather than the 0.3 percent as accomplished in Example I.

EXAMPLE VII

A red toner composition was prepared by repeating the procedure of Example I with the exception that there was selected 9.6 percent by weight of Litho Scarlet, 0.2 percent by weight of Hostaperm Pink, 45.2 percent by weight of the Pliolite resin, and 45 percent by weight of the styrene-n-butylmethacrylate resin. Also, there was added to this composition 0.5 percent by weight Aerosil R972.

Separate developer compositions were then prepared by admixing about 3 percent by weight of each of the toner compositions as prepared in Examples I to VII with 97 percent by weight of carrier particles consisting of a steel core with a coating thereover of a styrene, methacrylate, vinyl triethoxy silane terpolymer having incorporated therein 0.1 percent by weight of carbon black particles, and the percentage of Aerosil R972 indicated. The triboelectric charge and admix characteristics were then determined in a known charge spectograph with the following results:

| Example | Tribo Values (fc/u)[1] Percent Aerosil( ) | Admix (Minute) |
|---|---|---|
| I | −0.48 (0) | 5.0 |
| I | −0.82 (0.3) | 0.25 |
| II | −0.57 (0) | 3.0 |
| II | −0.88 (0.3) | 0.5 |
| III | −0.70 (0) | 5.0 |
| III | −1.00 (0.3) | 0.5 |
| IV | −0.40 (0) | 10.0 |
| IV | −0.80 (0.5) | 1.0 |
| V | −0.52 (0) | 3.0 |
| V | −0.65 (0.3) | 0.25 |
| VI | −0.10 (0) | 15.0 |
| VI | −0.62 (0.5) | 1.0 |
| VII | −0.18 (0) | 10.0 |
| VII | −0.70 (0.5) | 1.0 |

[1]Toner samples were charged against a carrier comprised of a 100 micron diameter ferrite coated with a methyl terpolymer of styrene, methacrylate, and vinyl triethoxy silane with carbon black dispersed therein at 0.6 percent by weight.

Additionally, the above-prepared developer compositions were incorporated into a Xerox Corporation 9500® imaging apparatus and there resulted images with excellent print quality, that is no development background, for example; and further the triboelectric charge present on the toner retained its value for 250,000 imaging cycles. Moreover, when an uncharged toner composition was added to the charged developers present in the 9500®, the uncharged developer achieved an appropriate charge, reference the data presented in the above tabulation in the periods of time indicated.

Figure 2:
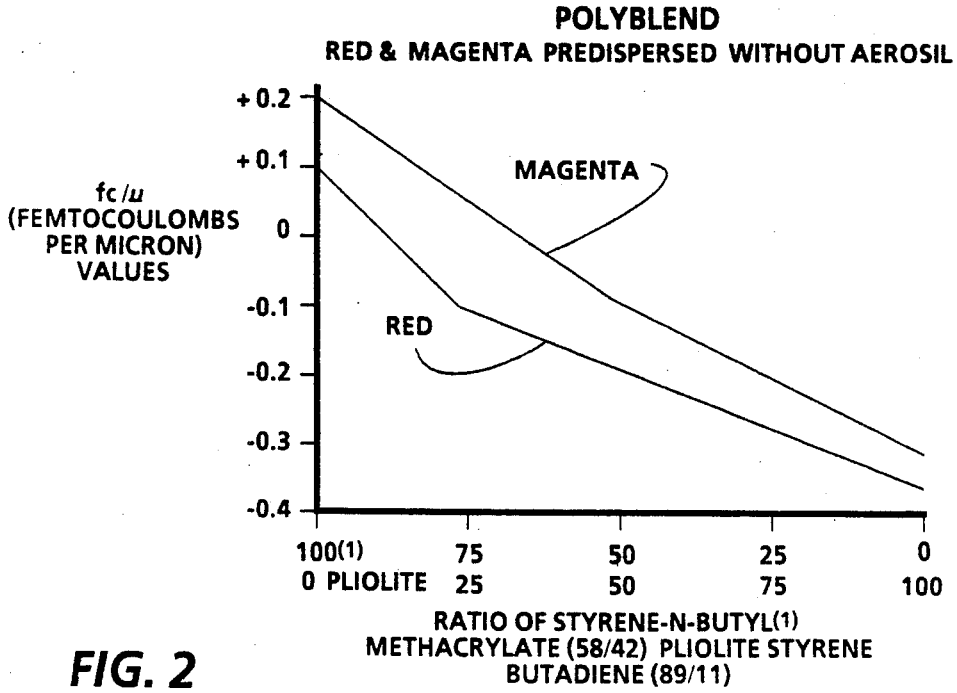

There were further generated line curves representing plots of the triboelectric charge in femtocoulombs per micron present on the toner versus the polymer ratio selected for the toner compositions of Examples I, II and V without Aerosil, reference FIG. 1. A similar plot was prepared for red and magenta polyblend toners without Aerosil, reference FIG. 2.

Other modifications of the present invention may occur to those skilled in the art based upon a reading of the present disclosure and these modifications are intended to be included within the scope of the present invention.

What is claimed is:

1. A process for generating consistent high quality colored images for extended periods consisting essentially of (1) providing a xerograhic imaging or printing apparatus; (2) adding thereto a stable two-component developer composition comprised of first polymer particles and second polymer particles, wherein the first polymer particles are selected from the group consisting of styrene methacrylates, styrene acrylates, styrene butadienes and polyesters' and the second polymer particles are selected from the group consisting of styrene methacrylates, styrene acrylates, styrene butadienes and polyesters, colored pigment particles other than black, and selected from the group consisting of cyan, yellow, magenta, red, green, and blue, colloidal silica, blended flow additive particles and carrier particles; (3) forming electrostatic latent images in the apparatuses; and (4) developing the images formed wherein the developer composition retains its triboelectric properties of from about −8 to about −30 microcoulombs per gram for over 500,000 imaging cycles, subject to the provision that the second polymer particles are of a different composition than the first polymer particles.

2. A process in accordance with claim 1 wherein the first resin particles are present in an amount of from about 30 percent by weight to about 65 percent by weight, and the seecond resin particles are present in an amount of from about 35 percent by weight to about 70 percent by weight, and wherein the total amount of the first resin particles second resin particles, and pigments particles total 100 percent.

3. A process in accordance with claim 1 wherein the first resin particles are comprised of a styrene n-butyl methacrylate present in an amount of from about 45 percent by weight to about 55 percent by weight, the second resin particles are comprised of a styrene butadiene polymer present in an amount of from about 55 percent by weight to about 45 percent by weight, and wherein the total amount of the first resin particles, second resin particles, and pigments particles total 100 percent.

4. A process in accordance with claim 1 wherein the colloidal silica is Aerosil.

5. A process in accordance with claim 1 wherein the additive particles are present in an amount of from about 0.1 percent by weight to about 1 percent by weight.

6. A process in accordance with claim 1 wherein the carrier particles contain a coating thereover.

7. A process in accordance with claim 1 wherein the carrier particles are comprised of a ferrite core or a steel core with a coating thereover.

8. A process in accordance with claim 1 wherein the carrier particles are comprised of a ferrite core or a steel core with a coating thereover selected from the group consisting of terpolymers of styrene/methacrylate and organo triethoxy silanes, and polymethacrylate.

9. A printing or imaging method which comprises forming an image on a photoconductive member, contacting the image with the developer composition of claim 1, followed by transferring the image to a suitable substrate, and permanently affixing the image thereto.

10. A printing or imaging method in accordance with claim 9 wherein the first resin particles are present in an amount of from about 30 percent by weight to about 65 percent by weight, and the second resin particles are present in an amount of from about 35 percent by weight to about 70 percent by weight, and wherein the total amount of the first resin particles, second resin particles, and pigments particles total 100 percent.

11. A printing or imaging method in accordance with claim 9 wherein the first resin particles are comprised of a styrene n-butyl methacrylate present in an amount of from about 45 percent by weight to about 55 percent by weight, and the second resin particles are comprised of a styrene butadiene polymer present in an amount of from about 55 percent by weight to about 45 percent by weight, and wherein the total amount of the first resin particles, second resin particles, and pigments particles total 100 percent.

12. A process in accordance with claim 9 wherein the colloidal silica is Aerosil.

13. A printing or imaging method in accordance with claim 9 wherein the additive particles are present in an amount of from about 0.1 percent by weight to about 1 percent by weight.

14. A printing or imaging method in accordance with claim 9 wherein the carrier particles contain a coating thereover.

15. A process in accordance with claim 1 wherein the pigment particles are present in an amount of from about 2 percent by weight to about 15 percent by weight.

16. A process in accordance with claim 1 wherein there is further included in the two component developer components selected from the group consisting of metal salts and metal salts of fatty acids.

17. A process in accordance with claim 16 wherein the components are present in an amount of from about 0.1 percent by weight to about 1 percent by weight.

18. A process in accordance with claim 16 wherein the components in zinc stearate.

19. A process in accordance with claim 1 wherein the first polymer particles are comprised of styrene methacrylates present in an amount of from about 50 percent by weight; the second polymer particles are comprised of styrene butadienes present in an amount of 45 percent by weight; and the pigment particles are present in an amount of 5 percent by weight.

20. A process in accordance with claim 19 wherein the colloidal silica is present in an amount of about 0.35 percent by weight.

* * * * *